US012225944B2

(12) United States Patent
Zominy

(10) Patent No.: US 12,225,944 B2
(45) Date of Patent: Feb. 18, 2025

(54) MOUTHPIECE PORTION FOR AN ELECTRONIC CIGARETTE

(71) Applicant: JT International SA, Geneva (CH)

(72) Inventor: Claude Zominy, Copponex (FR)

(73) Assignee: JT International S.A. (CH)

( * ) Notice: Subject to any disclaimer, the term of this patent is extended or adjusted under 35 U.S.C. 154(b) by 350 days.

(21) Appl. No.: 17/638,533

(22) PCT Filed: Aug. 28, 2020

(86) PCT No.: PCT/EP2020/074125
§ 371 (c)(1),
(2) Date: Feb. 25, 2022

(87) PCT Pub. No.: WO2021/038071
PCT Pub. Date: Mar. 4, 2021

(65) Prior Publication Data

US 2022/0287371 A1 Sep. 15, 2022

(30) Foreign Application Priority Data

Aug. 30, 2019 (EP) ..... 19194716

(51) Int. Cl.
*A24F 40/485* (2020.01)
*A24F 7/00* (2006.01)
(Continued)

(52) U.S. Cl.
CPC ..... *A24F 40/485* (2020.01); *A24F 7/00* (2013.01); *A24F 40/10* (2020.01); *A24F 40/42* (2020.01)

(58) Field of Classification Search
CPC ..... A24F 40/485; A24F 40/10; A24F 40/42; A24F 7/00
(Continued)

(56) References Cited

U.S. PATENT DOCUMENTS 4,771,796 A 9/1988 Myer
9,999,245 B1 6/2018 Zhu
(Continued)

FOREIGN PATENT DOCUMENTS

EP 3216477 A2 9/2017

OTHER PUBLICATIONS

International Search Report for Application No. PCT/EP2020/074125 dated Nov. 10, 2020, 2 pages.

*Primary Examiner* — Gary F Paumen
(74) *Attorney, Agent, or Firm* — Lerner David LLP

(57) ABSTRACT

The present invention relates to a mouthpiece portion for an electronic cigarette, the mouthpiece portion comprising a liquid store having a housing and being configured to store a liquid to be vaporized; a main vapor channel extending through the liquid store, between a vaporization chamber and a vapor outlet opening; a mouthpiece comprising a vapor inlet and a vapor outlet; wherein the mouthpiece portion is configured to provide a relative rotatable movement between the mouthpiece and the housing of the liquid store, between a first position and a second position; and wherein the mouthpiece portion is configured to be open and only dispense vapor through the mouthpiece vapor outlet when the mouthpiece portion is in the first position, in which the vapor outlet opening of the main vapor channel is aligned with the vapor inlet of the mouthpiece.

15 Claims, 7 Drawing Sheets

Figure 1A:
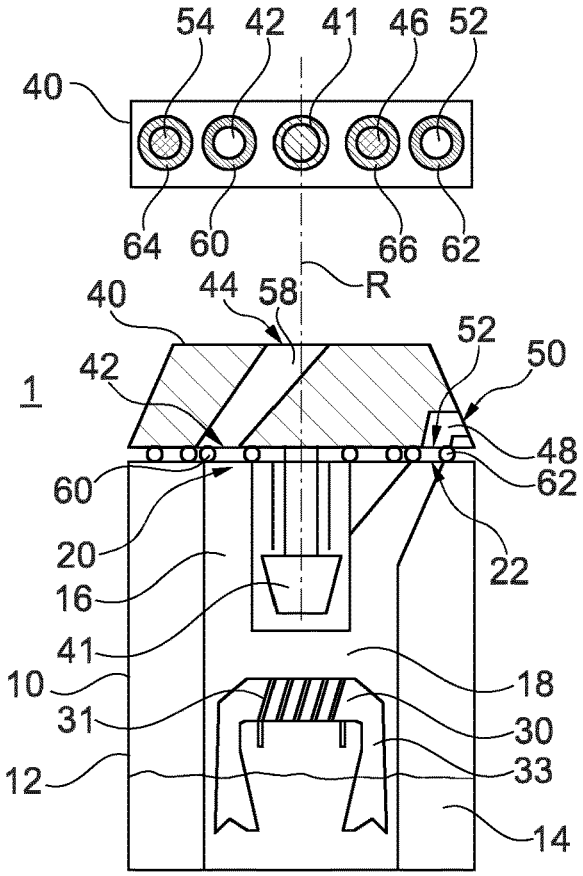

(51) Int. Cl.
*A24F 40/10* (2020.01)
*A24F 40/42* (2020.01)

(58) Field of Classification Search
USPC ..... 131/329
See application file for complete search history.

(56) References Cited

U.S. PATENT DOCUMENTS

| | | | | |
|---|---|---|---|---|
| 2016/0235121 | A1* | 8/2016 | Rogan | H05B 1/0227 |
| 2017/0112193 | A1* | 4/2017 | Chen | A24F 40/46 |
| 2018/0125118 | A1* | 5/2018 | Chen | A24F 40/46 |
| 2018/0289058 | A1 | 10/2018 | Chen | |
| 2018/0338542 | A1 | 11/2018 | Rogan et al. | |
| 2020/0054077 | A1* | 2/2020 | Chen | F16J 15/021 |
| 2020/0288779 | A1* | 9/2020 | Chen | A24F 40/46 |

* cited by examiner

MOUTHPIECE PORTION FOR AN ELECTRONIC CIGARETTE

CROSS-REFERENCE TO RELATED APPLICATIONS

The present application is a national phase entry under 35 U.S.C. § 371 of International Application No. PCT/EP2020/074125, filed Aug. 28, 2020, which claims priority to European Application No. 19194716.7, filed Aug. 30, 2019, the disclosures of which are incorporated herein by reference.

FIELD OF THE INVENTION

The present invention relates to personal vaporizing devices, such as electronic cigarettes. In particular, the invention relates to a mouthpiece portion for an electronic cigarette.

BACKGROUND

Electronic cigarettes are an alternative to conventional cigarettes. Instead of generating a combustion smoke, they vaporize a liquid, which can be inhaled by a user. The liquid typically comprises an aerosol-forming substance, such as glycerin or propylene glycol that creates the vapor. Other common substances in the liquid are nicotine and various flavorings. The electronic cigarette is a hand-held inhaler system, comprising a mouthpiece section, a liquid store and a power supply unit. Vaporization is achieved by a vaporizer or heater unit which typically comprises a heating element in the form of a heating coil and a fluid transfer element. The vaporization occurs when as the heater heats up the liquid in the wick until the liquid is transformed into vapor.

The electronic cigarette may comprise a chamber or a cartridge seating, which is configured to receive disposable consumables in the form of capsules. Capsules comprising the liquid store and the vaporizer are often referred to as "cartomizers".

The prior art document EP 3 216 477 A2 describes a mouthpiece assembly by which the amount of aerosol output can be adjusted. The mouthpiece assembly includes a blocking element at the base thereof, which defines at least one through hole and which is capable of preventing air from flowing through. The mouthpiece, when pushed inside, is capable of driving the blocking element to rotate relative to the base so that an area of at least one opening formed by the at least one through hole and an air inlet can be changed. Thus, the aerosol passage through the mouthpiece can be adjusted.

When the inlet and outlet openings of the liquid capsules of the prior art are open to the ambient there is on the one hand the risk of leaking and on the other hand the liquid may evaporate or dry out over the time, even when not in use. Thus, the need exists to provide a solution for preventing any undesired loss of liquid, particularly by leaking of liquid from a liquid capsule and by drying out.

SUMMARY OF THE INVENTION

The above-mentioned problem is solved by a mouthpiece portion for an electronic cigarette according to claim 1.

In a first aspect of the invention the mouthpiece portion for an electronic cigarette, comprising a liquid store having a housing and being configured to store a liquid to be vaporized; a main vapor channel extending through the liquid store, between a vaporization chamber and a vapor outlet opening; a mouthpiece comprising a vapor inlet and a vapor outlet; wherein the mouthpiece portion is configured to provide a relative rotatable movement between the mouthpiece and the housing of the liquid store between a first position and a second position; and wherein the mouthpiece portion is configured to be open and only dispense vapor through the mouthpiece vapor outlet when the mouthpiece is in the first position, in which the vapor outlet opening of the main vapor channel is aligned with the vapor inlet of the mouthpiece.

Thus, the mouthpiece and the liquid store directly cooperate for closing and opening of the vapor outlet opening. This provides for a structurally simple construction of the mouthpiece assembly that allows the user to easily fluidly connect the vapor outlet opening of the liquid store and the vapor inlet of the mouthpiece by rotation and alignment. To do so the user simply needs to rotate the mouthpiece in respect to the liquid store. Alternatively, the user may rotate the liquid store and the mouthpiece remains stationary. For the present invention only a relative rotational movement of the mouthpiece with respect to the liquid store is required. Further, the user can also easily block the vapor outlet opening of the liquid store by corresponding rotation of the mouthpiece with respect to the liquid store for avoiding any leaking and dry out of liquid through the vapor outlet opening of the liquid store.

Preferably, the liquid store is stationary arranged and the mouthpiece is rotatable. Alternatively, the mouthpiece is stationary arranged and the liquid store is rotatable. Thus, the mouthpiece portion is provided such that user can either rotate the mouthpiece or the liquid store for providing the desired relative rotatable movement. This allows design flexibility when realizing an electronic cigarette with a mouthpiece according the invention.

Preferably, the mouthpiece portion is configured as a cartridge, and further comprises a vaporizer, and wherein the cartridge is configured to be received into a cartridge seating of an electronic cigarette. Thus, the mouthpiece portion can be easily replaced at the electronic cigarette.

Preferably, the mouthpiece portion is closed when the vapor outlet opening of the main vapor channel of the liquid store is misaligned with the vapor inlet of the mouthpiece. Thus, no leaking or dry-out can happen if the user has not rotated the mouthpiece into the correct position for using the electronic cigarette.

Preferably, the mouthpiece portion comprises a selectively operable vapor closure arranged at the mouthpiece for closing the vapor outlet opening of the main vapor channel of the liquid store. The vapor closure serves for a tight closing of the vapor outlet opening.

Preferably the mouthpiece further comprises an air closing element that in the first position of the mouthpiece portion opens an air inlet opening of the liquid store and that in the second position of the mouthpiece portion closes the air inlet opening of the liquid store. The air closing element further selectively closes and opens the air inlet opening of the liquid store, which further avoids any leaking and dry out of liquid through the air inlet opening of the liquid store. Thus, by one rotational movement of the mouthpiece with respect to the liquid store both the air inlet opening and the vapor outlet opening of the liquid store can be opened and closed. This facilitates use of the electronic cigarette and avoids any leaking directly at the liquid store.

Preferably, the angle of rotation of mouthpiece between the second position and the first position amounts to less or equal to 180°. Thus, only a small rotation of max. 180° is necessary to open or close the mouthpiece portion.

Preferably the mouthpiece portion further comprises a first seal arranged either at the mouthpiece or the liquid store for sealing between the vapor outlet opening of the main vapor channel and the vapor inlet of the mouthpiece. The first seal seals the interface between the liquid store and the mouthpiece in the second position against leaking and dry out and in the first position against any bypassing vapor or air flow.

Preferably, the mouthpiece further comprises an air channel with an air inlet opening and an air outlet opening. Thus, the airflow for the vaporizer can be guided through the mouthpiece as well and can be selectively opened and blocked.

Preferably, the mouthpiece portion comprises a second seal arranged either at the mouthpiece or the liquid store for sealing between the air inlet opening of the mouthpiece and an air inlet opening to the vaporization chamber.

Preferably, the vapor inlet and the vapor closure of the mouthpiece are arranged at the mouthpiece mirror inverted with respect to a rotational axis of the mouthpiece and the liquid store. Thus, by rotation of the mouthpiece by 180° the vapor closure can adopt the location of the vapor inlet and vice versa. This allows a very easy and reliable configuration of the mouthpiece. Further, it is not required to prevent unlimited rotation of the mouthpiece by stop elements, or the like, although they might be provided if desired.

Preferably, a vaporizer is arranged within the main vapor channel, whereby the mouthpiece portion is configured as a cartridge. The vaporizer electrically vaporizes the liquid as known to the person skilled in the art. Since the mouthpiece portion is configured as a cartridge it can be exchanged and replaced at the electronic cigarette easily.

Preferably, the mouthpiece portion comprises an electric switch that is actuated by the rotation of the mouthpiece. The electric switch can automatically signal to the electronic cigarette's control electronics the condition of the assembly, preferably that the assembly is set to an open position.

Preferably, the electric switch comprises electric contacts arranged at the liquid store and an electrically conducting element at the mouthpiece, wherein the electrically conducting element electrically connects the electric contacts when the mouthpiece is rotated in the first position of the assembly. Such an electric switch is easy to manufacture, cost efficient and very reliable.

Preferably, the electric switch enables the activation of the vaporizer only in the first position of the assembly. This saves battery capacity and avoids any damage to the vaporizer if the electronic cigarette is presently not in use and the assembly in the closed position.

Preferably, the vapor outlet opening and the air inlet opening of the liquid store are both arranged essentially on the same surface facing the mouthpiece. This configuration enables an easy manufacturing and assembly of the liquid store.

Preferably, the vapor closure, the vapor inlet opening and if available the air outlet opening of the mouthpiece are all arranged essentially on the same surface facing the liquid store. This configuration enables an easy manufacturing of the mouthpiece and an easy assembly with the liquid store.

Preferably, the mouthpiece portion further comprises a position indicator at the mouthpiece, for indicating the rotational orientation of the mouthpiece with respect to the liquid store.

Preferably, the liquid store further comprises an air inlet valve that in the first position of the mouthpiece portion opens an air inlet opening of the liquid store and that in the second position of the mouthpiece portion closes the air inlet opening of the liquid store, wherein the mouthpiece comprises an actuating pin for selectively opening the air inlet valve. Thus, a specific air inlet valve is provided at the liquid store for selectively opening and closing the air inlet opening of the liquid store. The air inlet valve is selectively mechanically opened by an actuation pin at the mouthpiece.

A further aspect of the invention relates to an electronic cigarette comprising a mouthpiece portion as described before.

A further aspect of the invention relates to method of using a mouthpiece portion for an electronic cigarette, the assembly comprising a liquid store having a housing and being configured to store a liquid to be vaporized; a main vapor channel extending through the liquid store, between a vaporization chamber and a vapor outlet opening; a mouthpiece comprising a vapor inlet and a vapor outlet; wherein the mouthpiece portion is configured to provide a relative rotatable movement between the mouthpiece and the housing of the liquid store between a first position and a second position; wherein the method comprises the steps of a. rotating the mouthpiece with respect to the liquid store to the first position in which the vapor outlet opening of the main vapor channel is aligned with the vapor inlet of the mouthpiece for dispensing vapor through the mouthpiece vapor outlet; and
b. rotating the mouthpiece with respect to the liquid store to the second position in which the vapor outlet opening of the main vapor channel is mis-aligned with the vapor inlet of the mouthpiece for preventing dispense of vapor through the mouthpiece vapor outlet.

Thus, the user can simply rotate the mouthpiece in respect to the liquid store to a first position for aligning the vapor outlet opening of the liquid store with vapor inlet of the mouthpiece for dispensing vapor through the mouthpiece vapor outlet or to a second position in which the vapor outlet opening of the liquid store is mis-aligned with vapor inlet of the mouthpiece for preventing dispense of vapor through the mouthpiece. In the second position the vapor outlet opening of the liquid store is preferably closed by a vapor closure arranged at the mouthpiece. This on the one hand facilitates use of the electronic cigarette and on the other hand avoids any leaking and dry out directly at the liquid store without further elements.

Preferably, the method further comprises the step of manually connecting the liquid store with the mouthpiece by inserting a latch into a corresponding receptacle. This allows for a convenient assembly of the mouthpiece to the liquid store, which can be easily performed by the user of the electric cigarette when replacing the liquid store.

BRIEF DISCUSSION OF THE FIGURES

Figure 1B:
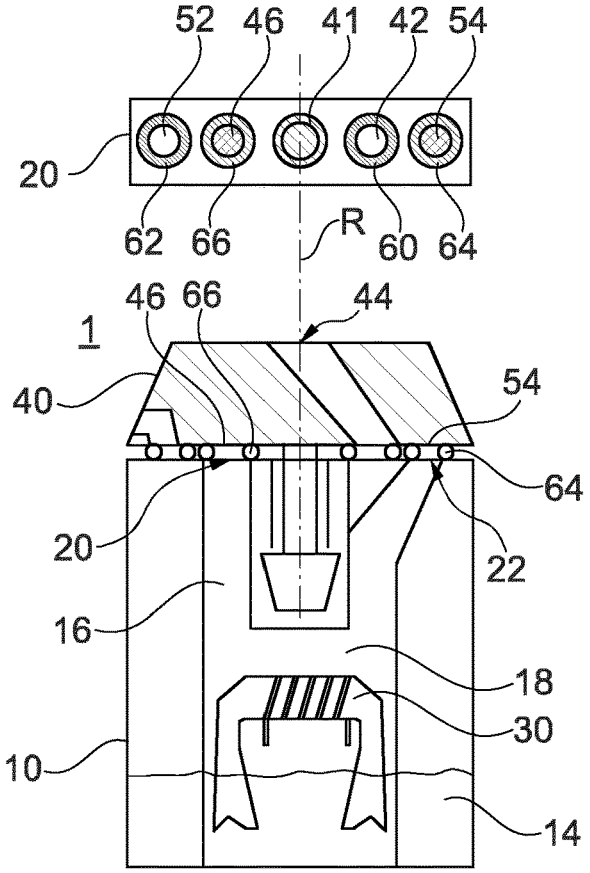
Figure 2:
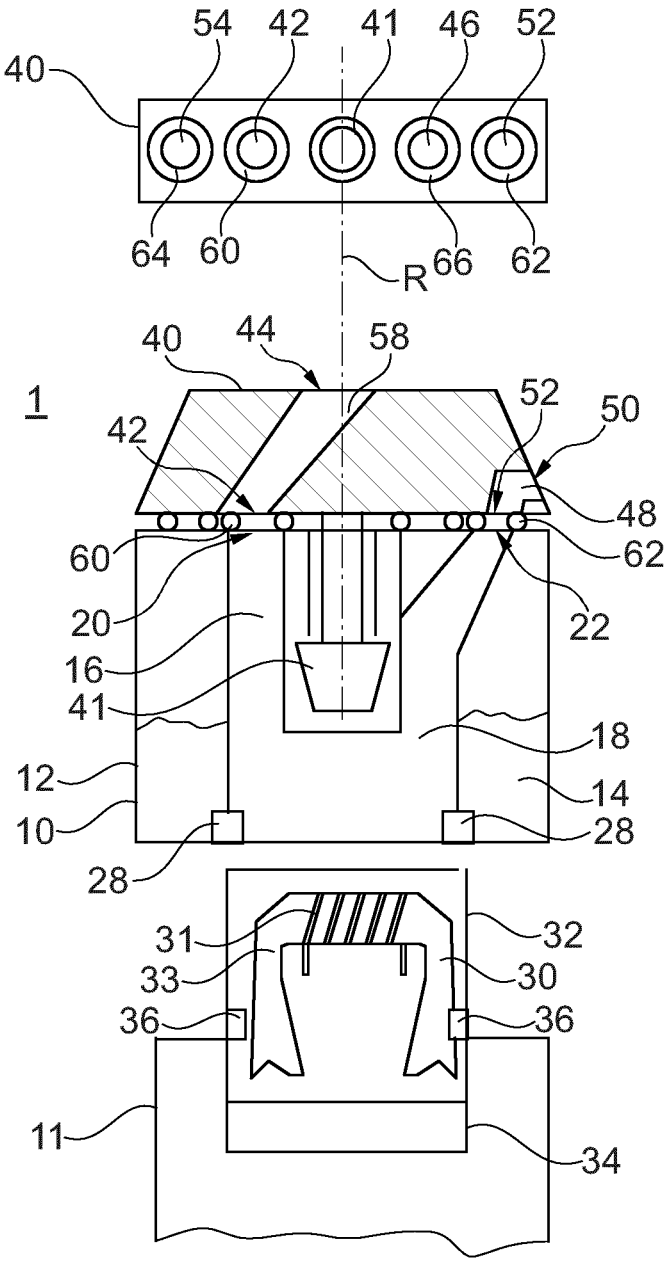
Figure 3:
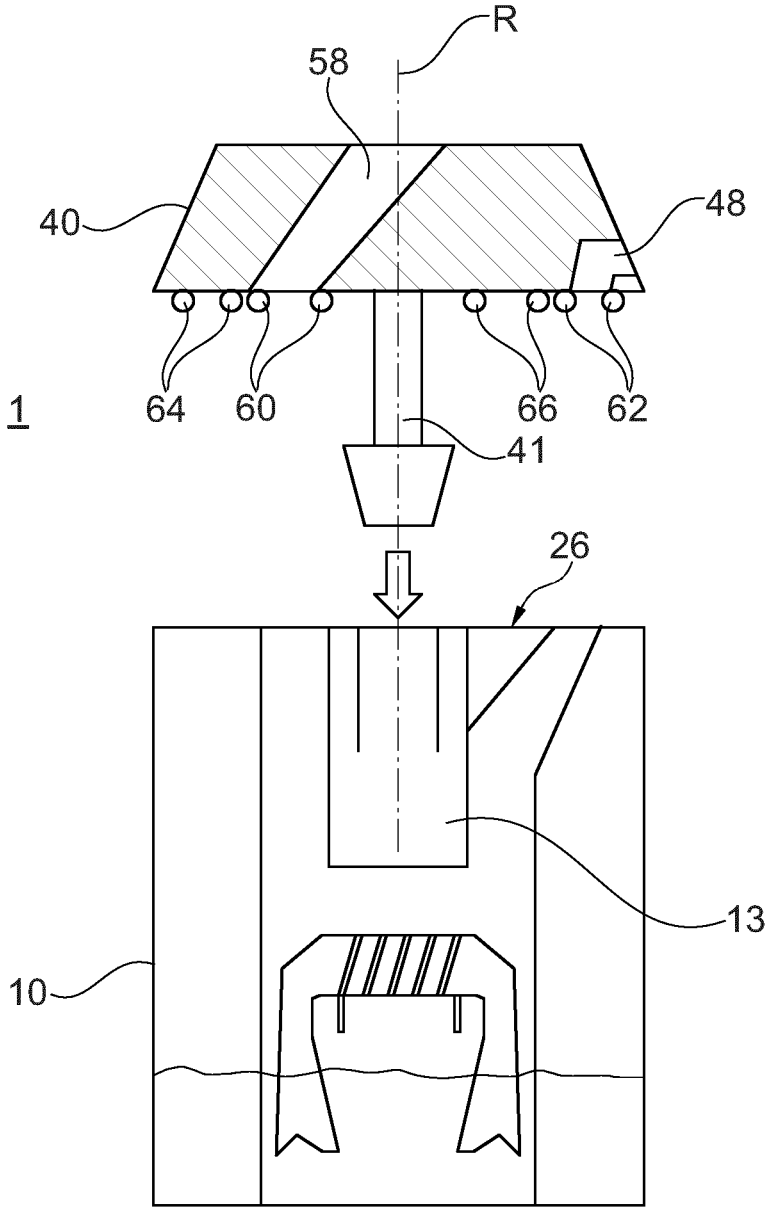
Figure 4A:
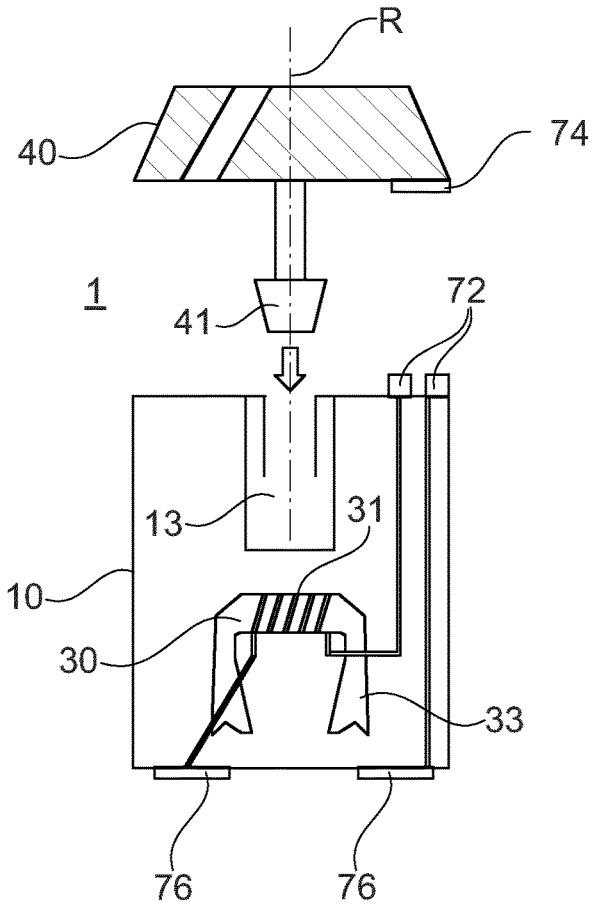
Figure 4B:
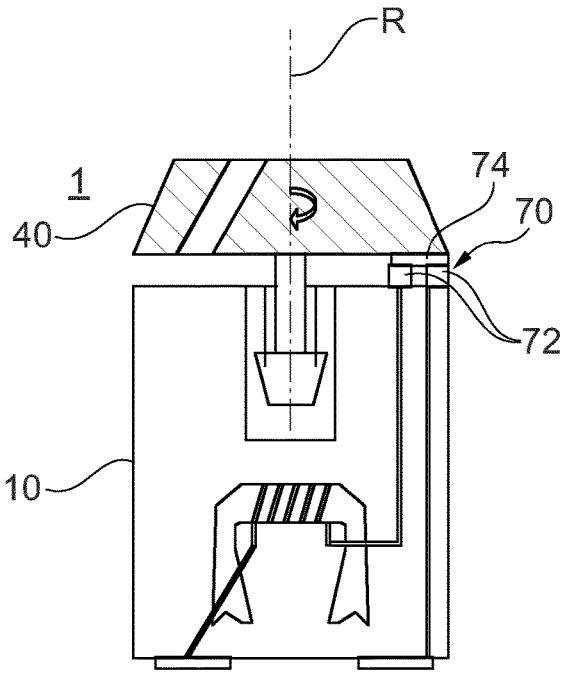
Figure 4C:
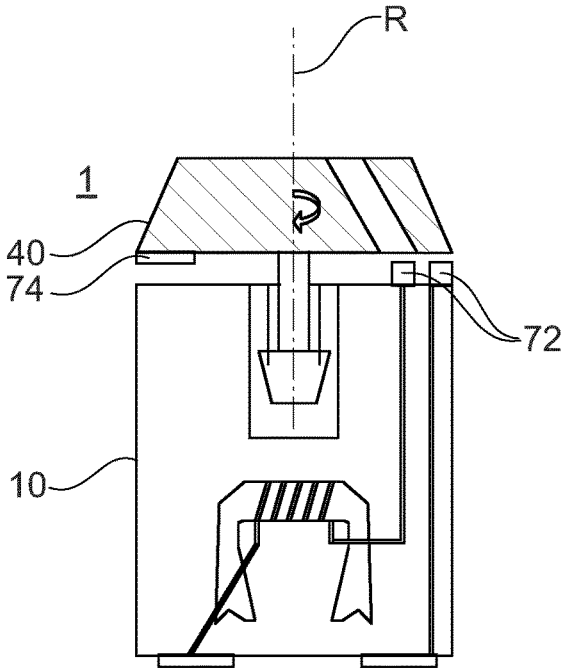
Figure 5:
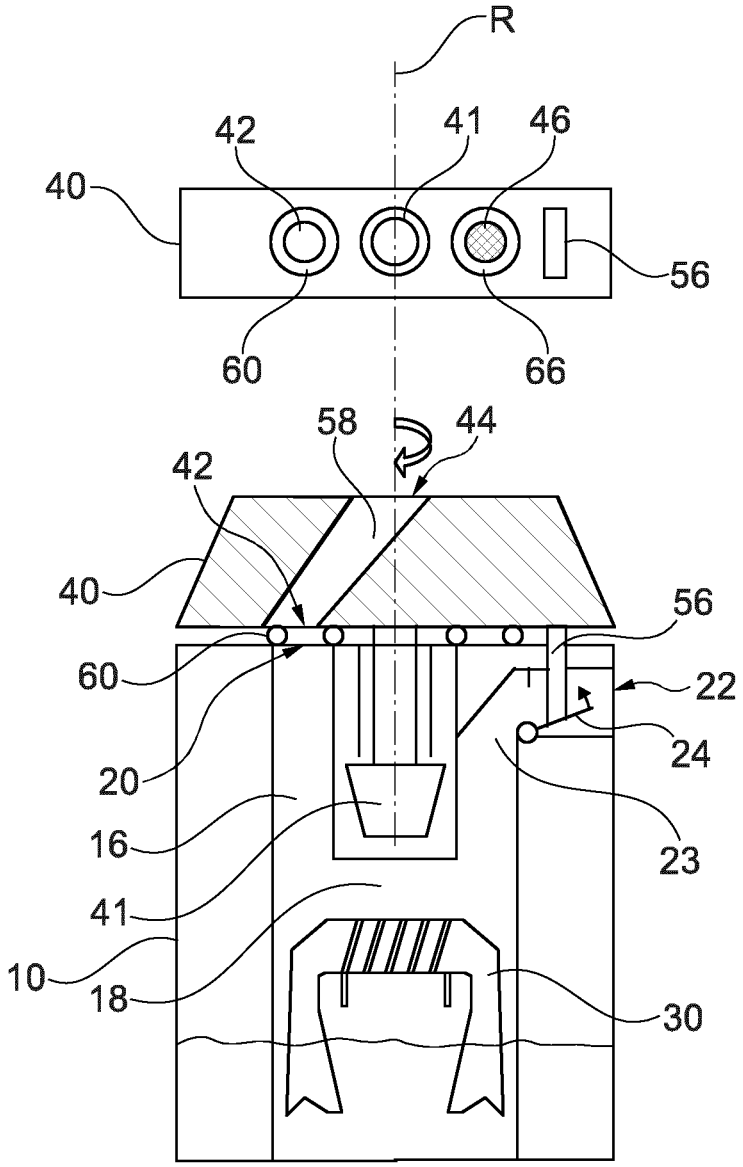
Figure 6A:
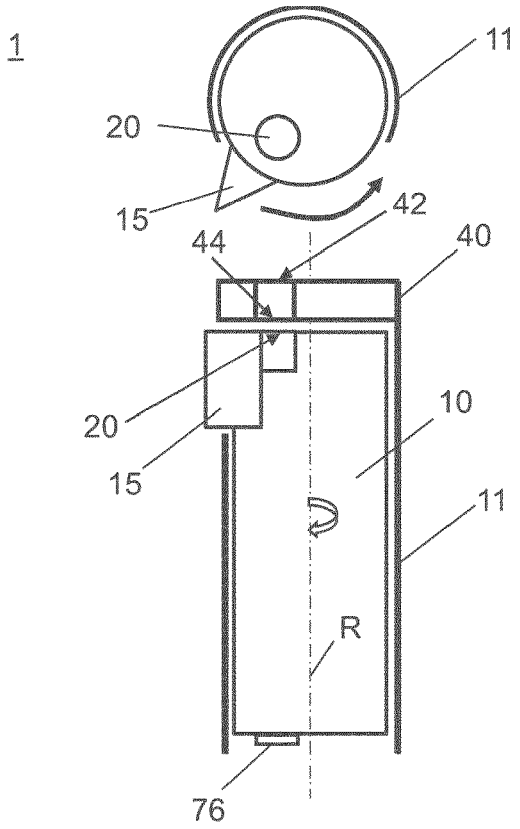
Figure 6B:
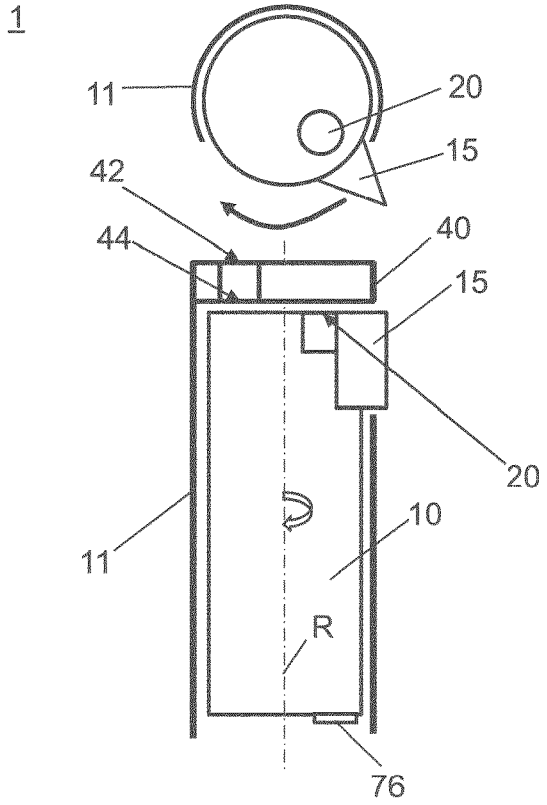
Figure 7C:
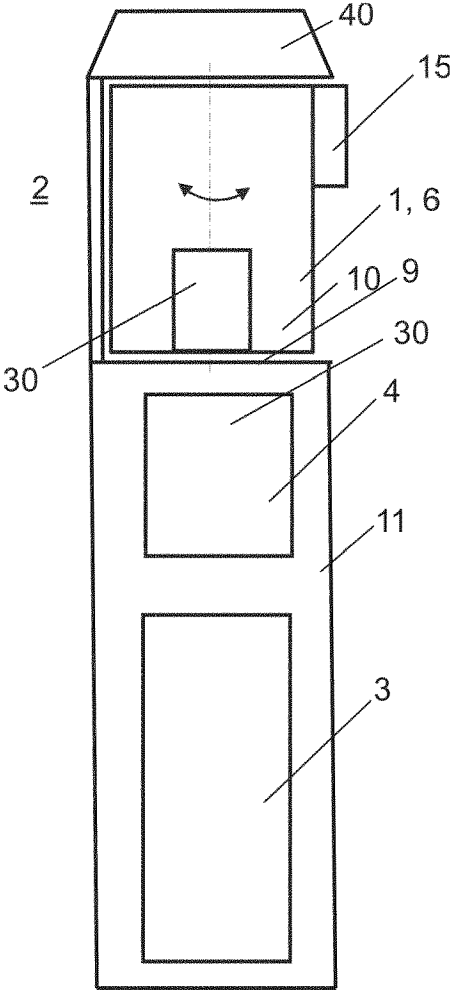
Figure 7B:
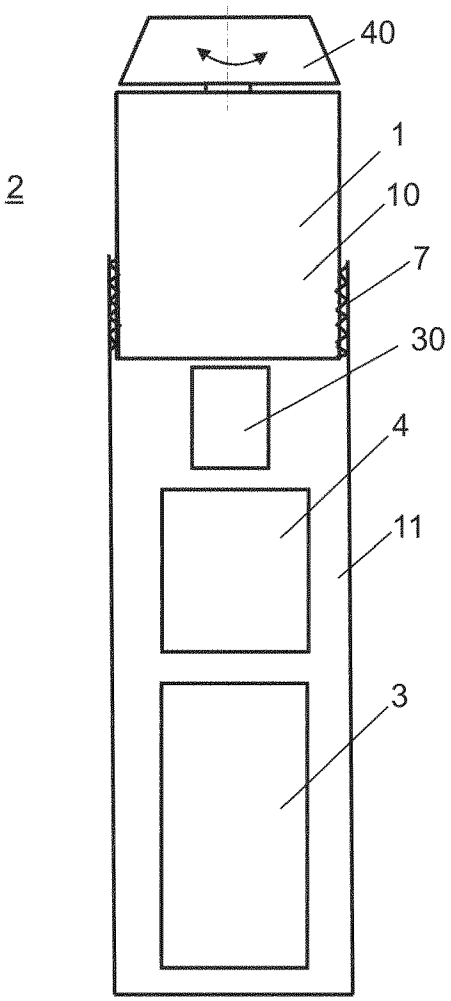
Figure 7A:
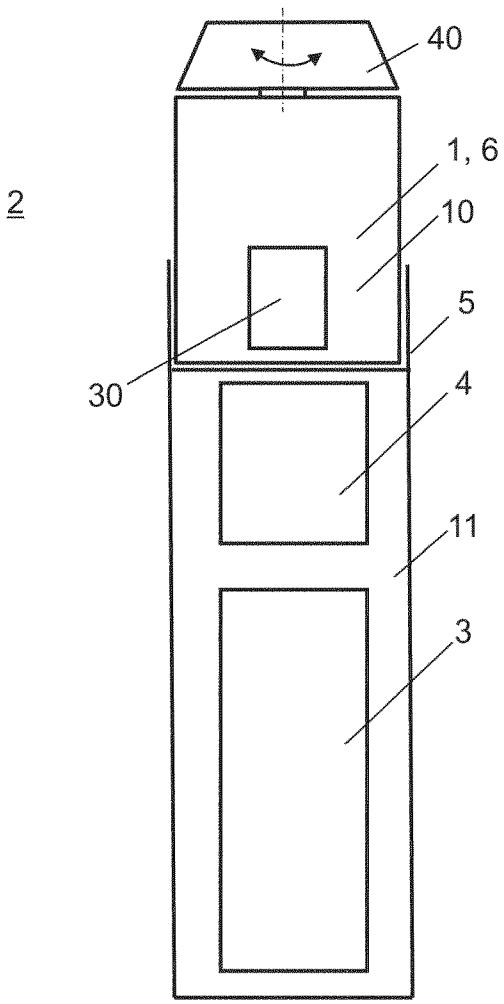

The invention will now be described with reference to the appended drawings, which by way of example illustrate embodiments of the present invention and in which like features are denoted with the same reference numerals, and wherein:

FIG. 1A: shows a schematic sectional view of an embodiment of a mouthpiece portion in a first position and the corresponding underside of the mouthpiece;

FIG. 1B: shows a schematic sectional view of the embodiment of FIG. 1A in a second position and the corresponding underside of the mouthpiece;

FIG. 2: shows a schematic sectional view of a second embodiment of a mouthpiece portion in a first position and the corresponding underside of the mouthpiece;

FIG. 3: shows the assembly process of the embodiment of a mouthpiece portion of FIG. 1A;

FIGS. 4A-4C: show the electric activation system of the embodiment of a mouthpiece portion of FIGS. 1 and 2;

FIG. 5: shows a third embodiment of a mouthpiece portion; and the underside of the corresponding mouthpiece in open position;

FIGS. 6A and 6B: show a third embodiment of a mouthpiece portion and the corresponding topside of the liquid cartridge; and FIG. 7A: shows schematically the main components of an electronic cigarette, wherein the mouthpiece portion is in the form of a releasable cartridge;

FIG. 7B: shows schematically the main components of an electronic cigarette, wherein the mouthpiece portion has re-fillable liquid store; and FIG. 7C: shows schematically the main components of an electronic cigarette, wherein the mouthpiece portion comprises a rotatable liquid store.

DETAILED DESCRIPTION

In the following preferred embodiments of the invention are described with respect to the figures. Although certain features are described with respect to specific embodiments, they may be used in other embodiments as well as appropriate.

As used herein and as schematically shown in FIGS. 7A, 7B and C, the "electronic cigarette" may include an electronic cigarette 2 configured to deliver an aerosol to a user, including an aerosol for smoking. An aerosol for smoking may refer to an aerosol with particle sizes of 0.5-7 microns. The particle size may be less than 10 or 7 microns. The electronic cigarette 2 may be portable. The electronic cigarette 2 has generally a main body 11 comprising a power supply unit, like a battery 3, and electrical control circuitry 4 for supplying a vaporizer 30 with electric energy.

Referring to FIGS. 1A and 1B a first embodiment of a mouthpiece portion 1 for an electronic cigarette 2 (see FIG. 2A) for vaporizing a liquid 14 is illustrated. The electronic cigarette 2 can be used as a substitute for a conventional cigarette.

The mouthpiece portion 1 comprises a mouthpiece 40 and a main housing 12. The mouthpiece 40 is configured to supply vapor to the user and is rotatably connected to the main housing 12. The mouthpiece 40 may have a tip-shaped form to correspond to the ergonomics of the user's mouth and has a vapor outlet 44 for delivering vapor to the user.

The mouthpiece portion 1 further comprises a liquid store 10 for storing liquid 14 to be vaporized, a vaporizer 30 for vaporizing the liquid 14, and a mouthpiece 40. In a preferred embodiment, the mouthpiece portion 1 can be configured as a disposable cartridge 6 that is releasably connectable to the main body of the electronic cigarette.

Alternatively, (as illustrated in FIG. 2) the mouthpiece portion 1 is configured as a so called "open tank" that can be refilled when depleted.

The housing of the mouthpiece portion 1 may be made of a transparent material, such that the liquid level within the liquid store 10 is clearly visible to the user. The housing of the mouthpiece portion may be formed in a polymeric or plastic material, such as polyester.

The liquid 14 may comprise an aerosol-forming substance such as propylene glycol or glycerol and may contain other substances such as nicotine. The liquid 14 may also comprise flavorings such as e.g. tobacco, menthol or fruit flavor.

The vaporizer is fluidically connected to the liquid store 10 for obtaining the liquid 14 to be vaporized. The vaporizer comprises a heating element 31 and a fluid transfer element 33, which is configured to transfer the liquid 14 by capillary action from the housing 12 to the heating element 31. The fluid transfer element 33 can be a fibrous or porous element such as a wick made from twined cotton or silica. Alternatively, the fluid transfer element 33 can be any other suitable porous element such as porous ceramic.

In the embodiment of FIG. 1 and FIG. 7A the vaporizer 30 is integral with the liquid store 10 and arranged within a vaporization chamber 18 thereof. In this embodiment the mouthpiece portion 1 is configured as a cartridge 6, that can be inserted as an integral element into the main body 11 of the electric cigarette 2. To do so the electric cigarette 2 comprises a cartridge seating 5 that is geometrically adapted to the cartridge 6 for holding the same and that has contacts for suppling electric energy to the vaporizer 30 within the cartridge 6.

In the second embodiment of FIG. 2 and FIG. 7B the vaporizer 30 is separate from the liquid store 10 and comprises a vaporizer housing 32. The vaporizer housing 32 is mounted on a vaporizer seating 34 of the main body 11. The vaporizer seating 34 also provides an electrical connection between the vaporizer 30 and the main body 11 that supplies the vaporizer 30 with electric energy. The vaporizer 30 of the embodiment of FIGS. 2 and 7B can be replaced independently from the liquid store 10. The supply of liquid 14 to the vaporizer is done via liquid valves 28 at the liquid store 10 that provide liquid to holes 36 at the outer side of the vaporizer housing 32. The liquid store 10 is preferably re-fillable a releasably connected to the main body 11, for example by a threaded connection 7 as shown in FIG. 7B.

In the embodiment of FIGS. 7A and 7B the liquid store 10 is stationary arranged and the mouthpiece 40 is rotatable.

The main cartridge housing 1 has a main vapor channel 16 with an air inlet opening 22 for receiving ambient air and a vapor outlet opening 20 for supplying vapor of the liquid 14 to the mouthpiece 40. The vaporizer is arranged within a vaporization chamber 18 connected to the main vapor channel 16 for vaporizing the liquid 14.

The mouthpiece 40 comprises a vapor channel 58 with a vapor inlet 42 for receiving vapor directly from the vapor outlet opening 20 of the main vapor channel 16 of the liquid store 10. The mouthpiece 40 further comprises a vapor outlet channel X provided with an inlet X at the vaporization chamber and a vapor outlet 44 for providing the vapor to the user.

The mouthpiece 40 may also comprise an air channel 48 with an air inlet opening 50 for receiving air from the ambient and an air outlet opening 62 for providing air through the liquid store 10 to the vaporizer 30.

The mouthpiece 40 is rotatably connected to the liquid store 10, for instance by a circular latch 41 that is inserted into a corresponding receptacle 13. As it can be seen best in FIG. 3 the connection can be simply established by manually snapping in the circular latch 41 into the receptacle 13 of the liquid store 10. This rotatable connection allows the liquid store 10 and the mouthpiece 40 to rotate with respect to each other.

For providing a first, open position of the mouthpiece portion 1 as shown in FIG. 1A the mouthpiece 40 can be rotated with respect to the liquid store 10, or the liquid store 10 can be rotated with respect to the mouthpiece 40, such that the vapor outlet opening 20 of the liquid store 10 and the vapor inlet 42 of the mouthpiece are superimposed. This enables a direct vapor flow from the main vapor channel 16 of the liquid store 10 to the vapor cannel 58 of the mouthpiece 40. Thus, in this first position of the mouthpiece portion 1 the user can use the electronic cigarette for smoking or inhaling.

In this first position of the mouthpiece portion 1 also the air outlet opening 52 of the mouthpiece 40 are advantageously superimposed with the air inlet opening 22 of the liquid store 10. Thus, fresh air can enter the main vapor channel 16, when vapor is withdrawn from the cigarette by the user.

For providing a second, closed position as shown in FIG. 1B the mouthpiece 40 can be rotated with respect to the liquid store 10, or the liquid store 10 can be rotated with respect to the mouthpiece 40, such that the vapor outlet opening 20 of the liquid store 10 and a vapor closure 46 of the mouthpiece 40 are superimposed. The vapor closure 46 may be a separate sealing or just a blind face at the outer side—particularly the underside—of the mouthpiece 40 covering the vapor outlet opening 20. It the second position the vapor outlet opening 20 of the liquid store 10 is closed, such that substantially no vapor, air or liquid can escape. Thus, any spilling, leaking or drying out of liquid 14 through this opening is avoided.

In addition, in the second position of the mouthpiece portion 1 also the air inlet opening 22 of the liquid store 10 is closed since an air closing element 54 superimposes with the air inlet opening 22, such that substantially no vapor, air or liquid can escape through this opening. Thus, any spilling, leaking or drying out through this opening is avoided as well.

In the embodiment of FIGS. 1 and 2 the angle of rotation for switching from the first to the second position of the assembly 1 is substantially 180°. However, other rotation angles, for example 90° or below 90° are also preferred. In such embodiments simply the arrangement of the inlet and outlet openings 20, 22, 42, 52 of the mouthpiece 40 and the liquid store 10 have to be arranged correspondingly. In the embodiment of FIGS. 6A and 6B the angle of rotation switching from the first to the second position is less than 90°, for example about 70°. Preferably, the rotatable connection of the mouthpiece 40 with respect to the liquid store 10 is such that only a rotation is needed to switch from first to second position and vice versa of the mouthpiece portion.

For avoiding any vapor or liquid leaks between the mouthpiece 40 and the liquid store 10 a first seal 60 between the vapor inlet 42 and the vapor outlet opening 20 is provided. The first seal 60 may be arranged at the mouthpiece 40 or at the liquid store 10.

Similarly, for avoiding any air leaks a second seal 62 is provided between the air outlet opening 52 of the mouthpiece 40 and the air inlet opening 22 of the liquid store 10. A third seal 64 seals between the air closing element 54 of the mouthpiece and the air inlet opening 22 of the main vapor channel 16 for avoiding any liquid leaks from the air inlet opening 22, when the mouthpiece portion 1 is in the second position as shown in FIG. 1B.

Similarly, a fourth seal 66 seals between the vapor closure 46 of the mouthpiece 40 and the vapor outlet opening 22 of the main vapor channel 16, when the mouthpiece portion 1 is in the closed position.

The seals 60, 62, 64 and 66 may be annular gaskets that are arranged around the openings 20, 22, 42, 52 or the air closing element 54 or the vapor closure 46. Generally, the seals 60, 62, 64 and 66 are arranged either at the outer surface of the mouthpiece 40 facing the liquid store 10 or at the outer surface of the liquid store 10 facing the mouthpiece 40. Preferably, the seals 60, 62, 64 and 66 may be arranged in corresponding annular grooves at the underside of the mouthpiece 40 and can rotate together with the mouthpiece 40. In other embodiments the seals 60, 62, 64 and 66 are preferably arranged in corresponding annular grooves of the liquid store 10 and can rotate together with the liquid store 10. The seals 60, 62, 64 and 66 may be elements independent from each other or may be a combined element with some or all of the seals 60, 62, 64 and 66.

FIGS. 4A-4C show details of the electric activation system of an embodiment of a mouthpiece portion 1. The vaporizer is electrically heated and receives electric energy from an energy source, for example an electric accumulator or battery (not shown) within the main body 11 via electric power supply contacts 76 arranged at the bottom side of the liquid store 10. One of the power supply contacts 76 is directly connected to the heating element 31 of the vaporizer 30. The other power supply contact 76 is electrically connected with the heating element 31 of the vaporizer 30 via an electronic switch 40. The electronic switch 40 conducts the electric energy when the mouthpiece portion 1 is rotated in the first position as shown in FIG. 4B. In this first position an electrically conducting element 74 at the mouthpiece 40 connects two electric contacts 72 at the liquid store 10 and closes an electric circuit. Thus, only in the first position of the mouthpiece portion 1 the vaporizer 30 can be electrically actuated.

FIG. 4C shows the assembly in the closed position, wherein the mouthpiece 40 is rotated by 180° with respect to FIG. 4B. In this position the electrical conducting element 74 is not connecting the electric contacts 72 and, thus, does not close the electric circuit to the vaporizer 30. This prevents any undesired actuation of the vaporizer 30.

FIG. 5 shows a third embodiment of a mouthpiece portion 1, that is similar to the first embodiment but differs thereof by an air channel 23 that is arranged only within the main cartridge housing 12. Thus, the mouthpiece 40 of the second embodiment has only a vapor channel 58 with a vapor inlet 42 and a vapor outlet 44. The air channel 48 with an air inlet and air outlet opening 32, 34 is thus provided in the main cartridge housing 12.

The air channel 18 within the main cartridge housing 12 comprises an air inlet valve 24 that automatically closes the air channel 23 if it is not being actuated. For selectively opening of the air inlet valve 24 the mouthpiece 40, preferably at its underside, comprises an actuating pin 56. In the first position of the mouthpiece portion 1 the actuating pin 56 opens the air inlet valve 24 for opening the air inlet opening 22. In the second position of the mouthpiece portion 1 the air inlet valve 24 is automatically closed, preferably by resilience of the valve 24 or by an additional spring.

FIG. 7C shows a further embodiment on an electronic cigarette 2, wherein the liquid store 10 is rotatable and the mouthpiece 40 is stationary arranged.

FIGS. 6A and 6B show further details of this fourth embodiment of a mouthpiece portion 1. The liquid store 10 is essentially cylindrically shaped and arranged within a corresponding receptacle 9 of a main body 11, such that the liquid store 10 is rotatable around rotation axis R with respect to the main body 11 and with respect to a mouthpiece 40 mounted at the main body 11. The liquid store 10 can further be in form of a cartridge 6 that comprises the vaporizer 30. The mouthpiece portion 1 can be brought from the first position of FIG. 6A into the second position of FIG. 6B by a rotation of the liquid store 10 with respect to the main body 11 and the mouthpiece 40.

The liquid store 10, like in the previous embodiments, comprises a vapor outlet opening 20 that can be aligned with a vapor inlet 44 of the mouthpiece 40 when the mouthpiece portion 1 is in the open position. If vapor outlet opening 20 is mis-aligned with the vapor inlet 44 of the mouthpiece 40 the mouthpiece portion 1 is in the closed position.

For allowing the user to rotate the liquid store 10, it comprises a position indicator 15 that preferably extends through the housing of the main body 11. The housing of the liquid store 10 may further comprise a protrusion configured as a grip surface in order to facilitate the rotation of the liquid store. In an advantageous embodiment, the position indicator is configured as a protrusion that also facilitates the rotation of the liquid store 10.

The liquid store 10 at the underside thereof further comprises power supply contacts 76 that provide electric energy to a vaporizer within a vaporization chamber (not shown in FIGS. 6A and 6B) inside the liquid store 10. Preferably, the power supply contacts 76 cooperate with corresponding contacts of the main body 11, such that they act as a switch that conducts electrical energy only, when the mouthpiece portion 1 is in the first position as shown in FIG. 6A.

LIST OF REFERENCE SIGNS

1 mouthpiece portion
2 electronic cigarette
3 battery
4 electrical control circuitry
5 seating
6 cartridge
7 threaded connection
9 receptacle for rotatable liquid store
10 liquid store
11 main body
12 housing
13 receptacle
14 liquid
15 position indicator
16 main vapor channel
18 vaporization chamber
20 vapor outlet opening
22 air inlet opening
23 air channel
24 air inlet valve
26 surface facing to the mouthpiece
28 liquid openings
30 vaporizer
31 heating element
32 vaporizer housing
33 fluid transfer element
34 vaporizer seating
36 holes
40 mouthpiece
41 latch
42 vapor inlet
44 vapor outlet
46 vapor closure
48 air channel
50 air inlet opening
52 air outlet opening
54 air closing element
56 actuating pin
58 vapor channel
60 first seal
62 second seal
64 third seal
66 fourth seal
70 electric switch
72 electric contacts
74 electrically conducting element
76 power supply contacts

The invention claimed is:

1. A mouthpiece portion for an electronic cigarette, the mouthpiece portion comprising:

a liquid store having a housing and being configured to store a liquid to be vaporized;

a main vapor channel extending through the liquid store, between a vaporization chamber and a vapor outlet opening;

a mouthpiece comprising a vapor inlet and a vapor outlet, wherein the mouthpiece portion is configured to provide a relative rotatable movement between the mouthpiece and the housing of the liquid store, between a first position and a second position, and wherein the mouthpiece portion is configured to be open and only dispense vapor through the mouthpiece vapor outlet when the mouthpiece portion is in the first position, in which the vapor outlet opening of the main vapor channel is aligned with the vapor inlet of the mouthpiece, and wherein the mouthpiece portion is configured to be closed and not dispense vapor through the mouthpiece vapor outlet when the mouthpiece portion is in the second position, in which the vapor outlet opening of the main vapor channel is not aligned with the vapor inlet of the mouthpiece.

2. The mouthpiece portion according to claim 1, wherein the liquid store is stationary and the mouthpiece is rotatable or wherein the mouthpiece is stationary and the liquid store is rotatable.

3. The mouthpiece portion according to claim 1, wherein the mouthpiece portion is configured as a cartridge, further comprising a vaporizer and wherein the cartridge is configured to be received into a cartridge seating of an electronic cigarette.

4. The mouthpiece portion according to claim 1, wherein the mouthpiece portion is closed when the vapor outlet opening of the main vapor channel of the liquid store is misaligned with the vapor inlet of the mouthpiece.

5. The mouthpiece portion according to claim 1, further comprising a selectively operable vapor closure arranged at the mouthpiece for closing the vapor outlet opening of the main vapor channel of the liquid store.

6. The mouthpiece portion according to claim 1, wherein the mouthpiece further comprises an air closing element that opens an air inlet opening of the liquid store when the mouthpiece portion is in the first position and that closes the air inlet opening of the liquid store when the mouthpiece portion is in the second position.

7. The mouthpiece portion according to claim 1, wherein the angle of rotation of the mouthpiece between the second position and the first position is equal to or less than about 180°.

8. The mouthpiece portion according to claim 1, further comprising a first seal arranged either at the mouthpiece or the liquid store for sealing between the vapor outlet opening of the main vapor channel and the vapor inlet of the mouthpiece.

9. The mouthpiece portion according to claim 8, wherein the mouthpiece further comprises an air channel with an air inlet opening and an air outlet opening.

10. The mouthpiece portion according to claim 9, further comprising a second seal arranged either at the mouthpiece or the liquid store for sealing between the air inlet opening of the mouthpiece and an air inlet opening to the vaporization chamber.

11. The mouthpiece portion according to claim 1, wherein the vapor inlet and a vapor closure of the mouthpiece are arranged at the mouthpiece mirror inverted with respect to a rotational axis of the mouthpiece and the liquid store.

12. The mouthpiece portion according to claim 1, wherein a vaporizer is arranged within the main vapor channel, whereby the mouthpiece portion is configured as a cartridge.

13. The mouthpiece portion according to claim 1, wherein the mouthpiece portion comprises an electric switch that is actuated by the relative rotatable movement of the mouthpiece.

14. The mouthpiece portion according to claim 13, wherein the electric switch comprises electric contacts arranged at the liquid store and an electrically conducting element at the mouthpiece, wherein the electrically conducting element electrically connects the electric contacts when the mouthpiece is rotated to the first position of the mouthpiece portion.

15. The mouthpiece portion according to claim 1, wherein the liquid store further comprises an air inlet valve that opens an air inlet opening of the liquid store when the mouthpiece portion is in the first position and that closes the air inlet opening of the liquid store when the mouthpiece portion is in the second position, and wherein the mouthpiece comprises an actuating pin for selectively opening the air inlet valve.

* * * * *